US007763407B2

(12) United States Patent
Behnke et al.

(10) Patent No.: US 7,763,407 B2
(45) Date of Patent: Jul. 27, 2010

(54) FIXING OF TONER IMAGES FOR DUPLEX PRINTING

(75) Inventors: Knut Behnke, Flintbek (DE); Hans-Otto Krause, Eckernfoerde (DE); Frank-Michael Morgenweck, Kiel (DE); Domingo Rohde, Kiel (DE); Detlef Schulze-Hagenest, Molfsee (DE); Lars Seimetz, Achterwehr (DE)

(73) Assignee: Eastman Kodak Company, Rochester, NY (US)

( * ) Notice: Subject to any disclaimer, the term of this patent is extended or adjusted under 35 U.S.C. 154(b) by 850 days.

(21) Appl. No.: 10/579,269

(22) PCT Filed: Oct. 20, 2004

(86) PCT No.: PCT/US2004/034828

§ 371 (c)(1),
(2), (4) Date: Jan. 29, 2007

(87) PCT Pub. No.: WO2005/052696

PCT Pub. Date: Jun. 9, 2005

(65) Prior Publication Data

US 2007/0281238 A1 Dec. 6, 2007

(30) Foreign Application Priority Data

Nov. 15, 2003 (DE) ..... 103 53 392

(51) Int. Cl.
*G03G 13/20* (2006.01)

(52) U.S. Cl. ..... 430/124.2; 430/124.4

(58) Field of Classification Search ..... 430/124.4, 430/124.2, 124.13, 124.1; 399/336, 337, 399/364

See application file for complete search history.

(56) References Cited

U.S. PATENT DOCUMENTS

| | | | | |
|---|---|---|---|---|
| 4,541,705 | A | 9/1985 | Knechtel | |
| 5,799,236 | A * | 8/1998 | Paczkowski | 399/309 |
| 6,683,287 | B2 | 1/2004 | Behnke et al. | |
| 2002/0088799 | A1 * | 7/2002 | Behnke et al. | 219/679 |

OTHER PUBLICATIONS esp@cenet abstract describing JP 57-109570 (pub. Jun. 1982).

* cited by examiner

*Primary Examiner*—Janis L Dote
(74) *Attorney, Agent, or Firm*—Lawrence P. Kessler; Donna P. Suchy; Christopher J. White

(57) ABSTRACT

Toner images applied on the first-side and on the second-side of a substrate are fixed together by microwaves, by being heated to a final fixing temperature, and that the toner image applied on the first-side is prefixed by microwaves before a toner image on the second-side is applied, with the toner image of the first-side being heated to a prefixing temperature that is lower than the final fixing temperature.

5 Claims, 1 Drawing Sheet

FIXING OF TONER IMAGES FOR DUPLEX PRINTING

FIELD OF THE INVENTION

The invention concerns fixing of a toner on a carrier or print, especially a sheet-like or web-like print, preferably for a digital printer.

BACKGROUND OF THE INVENTION

In digital printing, especially electrostatic or electrophotographic printing, a latent electrostatic image is produced, which is developed by charged toner particles, which, in turn, are transferred to a print, for example, paper that receives the image. The image transferred to the print is fixed there by heating and softening of the toner and/or heating of the print. The toner particles are bonded to the print, and possibly also to each other, through and during this process.

Contactless fixing is desirable, in principle, to protect the printed image. Other advantages of contactless fixing are the avoidance of adhesive wear and increased service life of the employed device on this account, as well as improved reliability of the device.

The use of microwaves is considered, in particular, for this purpose. However, a problem with microwave fixing is that it is a heating method that heats the substrate in bulk and increasingly drives out moisture from the substrate at higher temperatures, especially above about 100° C. This drying, particularly during duplex printing, can lead to strong stress and drying of the substrate, which can cause additional problems in further processing of the print. In particular, drying of the substrate during the first pass through the microwave fixer has consequences for the second pass, since the moisture of the substrate plays a role during the heating process of the substrate by microwaves. It must also be kept in mind that during fixing of a duplex print image, the first-side image is melted again.

SUMMARY OF THE INVENTION

The underlying task of the invention is to permit adequate fixing of toner on a print or substrate, especially for multicolor printing on a preferably sheet-like print or substrate, during duplex printing. This task is solved with respect to the invention in that the toner images applied in the first-side print and after second-side print are fixed together by microwaves, being heated to a final fixing temperature, and that the toner image applied in first-side print is prefixed by microwaves before the toner image of the second-side is applied, with the toner image of the first-side print being heated to a prefixing temperature that is lower than the final fixing temperature.

The fixing result of the microwave fixer depends essentially on the temperature during operation, to which the substrate, for example, paper, is heated during passage through the fixer. Different fixer results can be roughly distinguished with increasing temperature:

1. The toner is unfixed. The toner is not bonded or only insufficiently bonded to the substrate and can easily be wiped off again from the substrate.

2. The toner is partially fixed. The toner is melted, but not uniformly bonded to the substrate, and can be removed again from the substrate with little effort.

3. The toner is fixed, but still has non-uniform luster. The toner can no longer be wiped from the substrate, but the image quality is still adversely affected by the non-uniform luster.

4. The toner is fixed, and the fixing and image properties are good.

According to the invention, prefixing is preferably carried out after first-side print, with the prefixing temperature being chosen so that adhesion of the toner sufficient for subsequent second-side print is achieved on the first-side print on the substrate (initially), without considering the image quality. The fixation range explained above under paragraph number 3 is therefore sought. During second-side printing, the fixation range explained above under paragraph number 4 can be sought, in order to finally securely fix the printed image on the first-side print and on the second-side print with good image properties.

The transitions between the individual regions are continuous and cannot be precisely determined by measurement. In addition, the temperature with which a certain fixation result is achieved depends strongly on the employed toner material and can vary sharply. A toner that has a very sharp drop in modulus of elasticity G' during melting is preferred. It is in particular proposed, according to the invention, that the ratio of the modulus of elasticity G' at the reference temperature value, calculated from the initial temperature at the beginning of the glass transition point of the toner plus 50° C. to the value of the elastic modulus at the initial temperature, amounts to $<10^{-5}$, preferably $<10^{-7}$. This type of so-called SMT toner (sharp-melting toner) has already been disclosed in U.S. Pat. Nos. 6,740,462; 6,683,287; 6,686,573; and U.S. Publication No. 2002-0100754.

During the use of a toner material with such properties, it has been found that the temperature with which a fixation result with non-uniform luster can be achieved begins at about 90° C., whereas a good fixation result with uniform luster is only achieved above about 100° C. It is therefore preferably proposed to operate the microwave fixer during the fixation of a sheet provided for first-side printing and second-side printing, so that after first-side printing, the fixer heats the first-side only to a temperature between about 90° C. to 100° C., so that while a good image quality is not achieved, sufficient adhesion of the toner to the substrate is achieved. By this prefixing, the toner image of the first-side is fixed and is insensitive during second-side printing and to damage by contact. After second-side printing, the substrate is then heated to a fixing temperature above about 100° C., so that the first-side and second-side can be fixed together. At the same time, loading and drying of the substrate can be kept as low as possible so that, on the one hand, further processing becomes simpler and, on the other hand, the microwave fixer can be used with otherwise identical settings during first-side printing and second-side printing, in particular, no other power setting on the fixer need be made. In addition to lower substrate stress, the invention also has the advantage of saving energy.

In the invention, a dry toner that is still not hard at an average temperature of about 50° C. to 70° C. can be used, so that it can be ground via conventional methods to a desired average toner size of about 4 to 8 μm, and is also still not tacky or melts at the development temperatures, but, at higher temperatures of about 90° C., is already very fluid with a low viscosity, so that optionally, with the use of capillarity, it settles on the print even without external pressure and adheres to it without contact. Also, during cooling, it very rapidly becomes hard again and is fixed, and has a good surface luster adapted to the print, particularly because of a lack of formed grain boundaries. The latter play a significant role in the color toner for color saturation.

In conjunction with the toner according to the invention, the ratio of the modulus of elasticity value G' at the reference temperature, calculated from the initial temperature at the beginning of the glass transition point of the toner plus 50° C. to the value of the elastic modulus at the initial temperature itself can be $<10^{-5}$, preferably even $<10^{-7}$.

The initial temperature at the beginning of the glass transition of the toner is preferably defined as that temperature value at which the tangents to the functional trend of the modulus of elasticity G', as a function of temperature, intersect before and after the glass transition. The transition of the toner from the solid to liquid state should preferably occur in a temperature range or a temperature window of about 30° C. to 50° C. This region should lie above 60° C., preferably between 70° C. and 130° C., and most preferably between 75° C. and 125° C.

In principle, all frequencies of the microwave range from 100 MHz to 100 GHz can be used. Ordinarily, the ISM frequencies released for industrial, scientific, or medical use, preferably 2.45 GHz, are used. The use of other frequencies in the mentioned broad frequency range, however, can advantageously mean that a greater fraction of the radiation energy than usual is absorbed by the toner and not just by the print.

BRIEF DESCRIPTION OF THE DRAWINGS

Explanations of the invention occur below in conjunction with two figures, from which additional inventive expedients are apparent, without the invention being restricted to the explained examples of figures. In the figures.

DETAILED DESCRIPTION OF THE INVENTION

Figure 1:
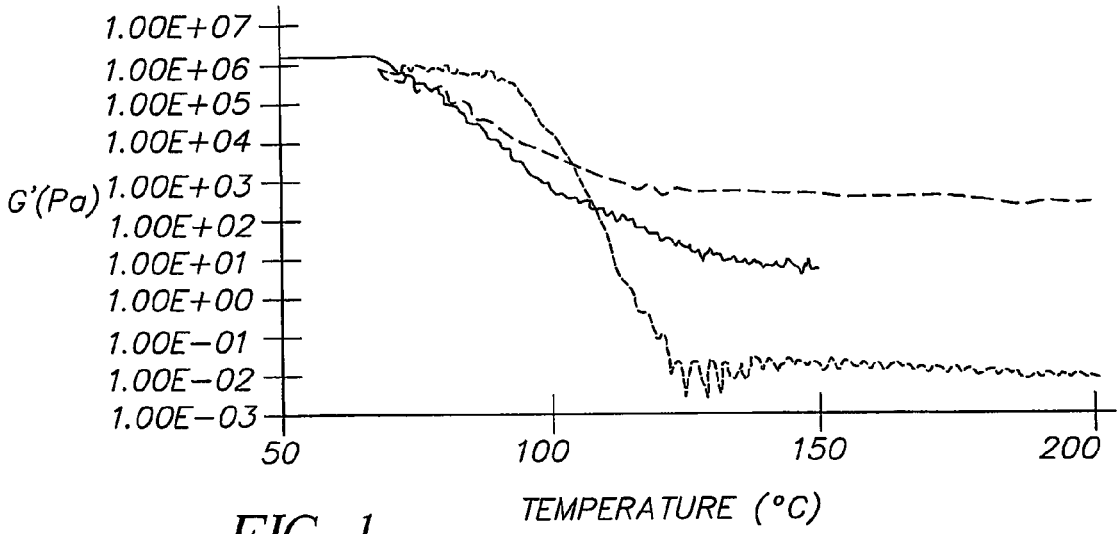
FIG. 1 shows the measured functional trends of three toners for comparison.

The measured functional trend of G' for the three example toners is shown in FIG. 1. The functional values of G' were determined by a Theological measurement with a Bolin rheometer equipped with parallel plates 40 mm in diameter. A continuous temperature change at a frequency of 1 rad/s was carried out, corresponding to 0.16 Hz between 50° C. and 200° C. The strain of the measurement was chosen, so that the sample exhibits no shear dilution (Newtonian behavior). Only one of the toners exhibits a sharp transition from the solid to liquid state with a final G' value of about $1.00\times10^{-2}$. A G' ratio of $5.0\times10^{-8}$ results from this.

Figure 2:
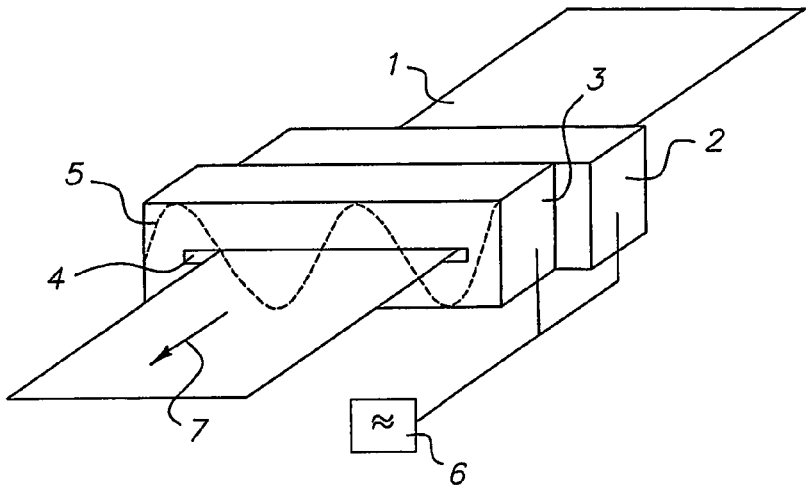
FIG. 2 shows a schematic perspective of a microwave fixer.

FIG. 2 schematically depicts an example of a perspective view of an embodiment of a device according to the invention for the fixing of a toner image. A section of a conveyor belt 1 is shown in FIG. 2, on which sheets of a sheet-like print can be placed in succession and transported. This conveyor belt 1 passes through a fixer device, having essentially two resonators 2 and 3 arranged offset relative to each other, and specifically through a relatively narrow slit 4 in these resonators 2 and 3.

As shown in FIG. 2, standing microwaves 5 are formed in resonators 2 and 3, the maxima of which occurs in the plane of the conveyor belt 1 or the print situated on it. Because of microwaves, the print and the toner image on it are heated so that the toner image melts and is fixed to the print when cooled outside of resonators 2, 3. As is apparent in FIG. 2, the resonators 2 and 3 are arranged offset relative to each other by a fourth of the wavelength of the microwaves 5, in order to achieve a corresponding offset of the maxima of the microwaves 5, and to heat the print and the toner image relatively uniformly.

To form the microwaves, the resonators 2, 3 are supplied with an AC voltage from a voltage source 6. The conveyor belt 1 and the print situated on it move in the direction of arrow 7 through resonators 2, 3, for example, at a speed of up to one meter per second.

The invention claimed is:

1. Method for fixing toner images applied to a substrate on a first-side and a second-side of a substrate comprising the steps of:

the toner images applied on the first-side and second-side are fixed together by microwaves, being heated to a final fixation temperature, and the toner image applied on the first-side is prefixed by microwaves before a toner image is applied on the second-side, with the toner image of the first-side being heated to a prefixing temperature that is lower than the final fixing temperature, wherein the ratio of the modulus of elasticity G' at a reference temperature, calculated from the initial temperature at the beginning of the glass transition point of the toner plus 50° C. to the value of the modulus of elasticity at the initial temperature is $<10^{-5}$, the transition of the toner from the solid to the liquid state occurs in a temperature window of about 30° C. to 50° C., the mentioned temperature range of the state change of the toner extends in the range of about 75° C. to about 125° C., and the prefixing temperature is chosen in a temperature region of about 90° C. to 100° C.

2. Method according to claim 1, wherein the final fixing temperature is chosen to be above about 100° C.

3. Method for fixing toner images applied to a substrate on a first-side and a second-side of a substrate comprising the steps of the toner images applied on the first-side and second-side are fixed together by microwaves, being heated to a final fixation temperature, and the toner image applied on the first-side is prefixed by microwaves before a toner image is applied on the second-side, with the toner image of the first-side being heated to a prefixing temperature that is lower than the final fixing temperature, wherein the ratio of the modulus of elasticity G' at a reference temperature, calculated from the initial temperature at the beginning of the glass transition point of the toner plus 50° C. to the value of the modulus of elasticity at the initial temperature, is $<10^{-5}$, the transition of the toner from the solid to the liquid state occurs in a temperature window of about 30° C. to 50° C., and the prefixing temperature is chosen in a temperature region of about 90° C. to 100° C.

4. Method for fixing toner images applied to a substrate on a first-side and a second-side of a substrate comprising the steps of:

the toner images applied on the first-side and second-side are fixed together by microwaves, being heated to a final fixation temperature, and the toner image applied on the first-side is prefixed by microwaves before a toner image is applied on the second-side, with the toner image of the first-side being heated to a prefixing temperature that is lower than the final fixing temperature, wherein the ratio of the modulus of elasticity G' at a reference temperature, calculated from the initial temperature at the beginning of the glass transition point of the toner plus 50° C. to the value of the modulus of elasticity at the initial temperature, is $<10^{-5}$, the transition of the toner from the solid to the liquid state occurs in a temperature window of about 30° C. to 50° C., and the final fixing temperature is chosen to be above about 100° C.

5. Method of claim 4, wherein the prefixing temperature is chosen in a temperature region of about 90° C. to 100° C.

* * * * *